US008011397B2

(12) United States Patent
Tönnigs et al.

(10) Patent No.: US 8,011,397 B2
(45) Date of Patent: Sep. 6, 2011

(54) CASE CLAMP

(75) Inventors: Bodo Tönnigs, Lichtenberg (DE); Sven Tönnigs, Lichtenberg (DE)

(73) Assignee: Ligmatech Automationssysteme GmbH, Lichtenberg (DE)

( * ) Notice: Subject to any disclaimer, the term of this patent is extended or adjusted under 35 U.S.C. 154(b) by 1023 days.

(21) Appl. No.: 11/712,405

(22) Filed: Mar. 1, 2007

(65) Prior Publication Data

US 2007/0257583 A1 Nov. 8, 2007

(30) Foreign Application Priority Data

May 3, 2006 (EP) ..... 06009146

(51) Int. Cl.
*B27B 31/00* (2006.01)

(52) U.S. Cl. ..... 144/250.18; 269/32; 29/252

(58) Field of Classification Search ..... 144/245.3, 144/250.18; 269/43, 32, 291, 34
See application file for complete search history.

(56) References Cited

U.S. PATENT DOCUMENTS

| | | | | | |
|---|---|---|---|---|---|
| 3,405,812 | A | * | 10/1968 | Kolbus | 414/737 |
| 3,924,668 | A | * | 12/1975 | Cromeens | 144/244 |
| 4,547,255 | A | * | 10/1985 | Yow | 156/580 |
| 4,627,564 | A | * | 12/1986 | Bowser | 227/152 |
| 4,997,514 | A | * | 3/1991 | Bielfeldt | 156/558 |
| 5,146,962 | A | * | 9/1992 | Drees | 144/137 |
| 5,240,051 | A | * | 8/1993 | Quick et al. | 144/352 |
| 5,692,283 | A | * | 12/1997 | Olive | 29/252 |
| 5,873,569 | A | * | 2/1999 | Boyd et al. | 269/43 |
| 5,933,933 | A | * | 8/1999 | Fritz et al. | 29/33 P |
| 6,206,069 | B1 | * | 3/2001 | Saukkonen | 156/443 |
| 6,315,860 | B1 | * | 11/2001 | Holmberg et al. | 156/583.1 |
| 6,779,576 | B2 | * | 8/2004 | Cable | 156/538 |
| 7,003,865 | B1 | * | 2/2006 | Blevio, Sr. | 29/561 |
| 7,066,458 | B2 | * | 6/2006 | McIntosh et al. | 269/34 |
| 7,341,246 | B2 | * | 3/2008 | Donohue | 269/37 |

FOREIGN PATENT DOCUMENTS

| | | | |
|---|---|---|---|
| DE | 25 53 814 | A1 | 6/1976 |
| DE | 196 19 605 | A1 | 11/1996 |
| EP | 1 046 482 | A1 | 10/2000 |
| EP | 1 593 472 | A1 | 11/2005 |

* cited by examiner

*Primary Examiner* — David J. Walczak
*Assistant Examiner* — Jennifer Chiang
(74) *Attorney, Agent, or Firm* — Finnegan, Henderson, Farabow, Garrett & Dunner, L.L.P.

(57) ABSTRACT

A case clamp (20) for clamping carcass parts to furniture carcasses, such as tail cupboards, top or bottom cupboards, having a base frame (1), a lower compression beam (1') provided on the base frame (1), at least two supports (2, 3) disposed on the base frame (1), of which at least one is traversable horizontally on the base frame (1), at least two pairs of horizontal compression beams (6, 7) disposed on the supports (2, 3) so as to be horizontally traversable, and an upper compression beam (4) disposed on the supports (2, 3) so as to be vertically traversable, wherein in each case the supports (2, 3) are supported exclusively on the base frame (1) in the vertical direction at least and are free at the opposing end (2', 3').

9 Claims, 2 Drawing Sheets

CASE CLAMP

FIELD OF THE INVENTION

The present invention relates to a case clamp for clamping carcass parts to furniture carcasses, such as tall cupboards, top or bottom cupboards.

PRIOR ART

A case clamp of the kind referred to initially is disclosed for example in EP 1 046 482 A and has a torsion-resistant, upright support frame with a front and a rear, a pair of vertical compression beams with one upper and one lower compression beam, both of which project from the support frame at the front, whereby one of the compression beams is vertically adjustable by means of a drive and is supported on the support frame and the other compression beam is rigidly connected to the support frame. In addition, the known case clamp has a pair of horizontal compression beams with one right-hand and one left-hand compression beam, both of which project from the front of the support frame at least during compression, and both of which can be traversed on the support frame in the gap between the pair of vertical compression beams by means of horizontally traversable supports.

The known case clamp has proven itself in practical use. However, the need exists to further simplify the structural design to enable better access and to minimise the requirement for space.

PRESENTATION OF THE INVENTION

The object of the present invention is, therefore, to provide a case clamp of the type referred to initially which has better accessibility and lower space requirements with a simplified structural design.

This object is achieved according to the invention by a case clamp for clamping of carcass parts to furniture carcasses, such as tall cupboards, top or bottom cupboards, having:
a base frame, a lower compression base provided on the base frame, at least two supports disposed on base frame, of which at least one is traversable horizontally on the base frame, at least two pairs of horizontal compression beams, disposed on the supports so as to be vertically traversable, and an upper compression beam disposed on the supports so as to be vertically traversable characterized in that in each case the supports are supported exclusively on the base frame in the vertical direction at least and are free at the opposing end.

The invention is based on the idea of being fundamentally able to modify or optimise the dissipation of loads arising during clamping. To this end, according to the invention, it is provided in a case clamp of the generic kind that in each case the supports are supported exclusively on the base frame in the vertical direction at least and are free at the opposing end. In the case clamp according to the invention, it is possible in this manner to dispense completely with the upright support frame present in prior art with the result that a large proportion of the bulky and heavy components of the case clamp are dispensed with and the case clamp's construction is simplified enormously. Furthermore, loss of the support frame also considerably improves access to the case clamp and the case clamp advantageously requires significantly less space.

Supporting of the supports on the base frame may be achieved in a variety of ways within the scope of the present invention. According to a development of the invention, it is, however, envisaged to support each of the supports on the base frame by way of at least two guide elements to enable the dissipation of high compression forces with easy traversability of the supports. The guide elements concerned are preferably guide rails.

Within the scope of the present invention, the positioning drive for the upper compression beam may be integrated, for example, in the supports. According to a development of the present invention, it is, however, envisaged that the case clamp also has a drive pillar for the upper compression beam which has a drive, in particular a servo-drive. This prevents the construction of the supports from being unduly complex without the overall design becoming noticeably more complicated. In addition, the high forces of the upper compression beam occurring during compression are dissipated directly into the base frame via the drive pillar.

In order to further relieve the pressure on the overall construction of the case clamp and on the drive in particular, it is envisaged according to a development of the invention that the case clamp also has a counterweight. As a result of this the drive need not continuously compensate the weight of the upper compression beam. In this case, it is especially preferable for the counterweight to be integrated in the drive pillar so that the drive and the counterweight can co-operate directly. It has also proven advantageous for the counterweight to function pneumatically.

Although the case clamp according to the invention can work in principle as a stationary machine, it is envisaged according to a development of the present invention that the case clamp also has a feed device. This allows the case clamp to be integrated advantageously into a production line in which the carcasses to be clamped are processed in a continuous cycle. In this regard it is especially preferable that the feed device is integrated in the lower compression beam resulting in a trouble-free and efficient operation of the case clamp according to the invention.

Within the scope of the invention, it should further be noted that the supports may also be fitted with compression beams on two opposing sides, and/or that on the base frame, for example, two opposing rows of supports may also be disposed, for example in the case of very deep carcasses.

DETAILED DESCRIPTION OF PREFERRED EMBODIMENTS

Preferred embodiments of the present invention will be described in detail in the following with reference to the accompanying drawings.

Figure 1:
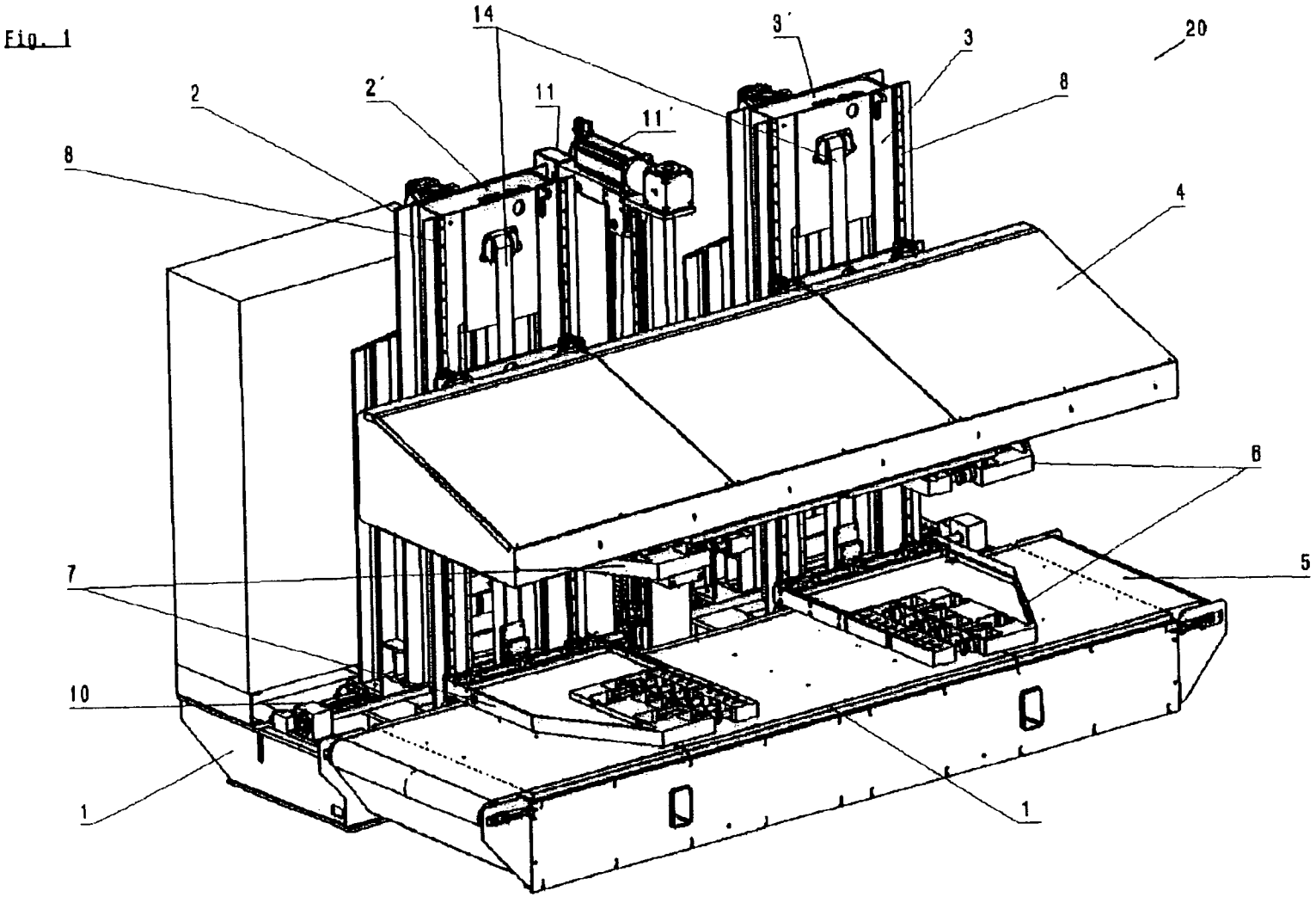
FIG. 1 shows a diagram in perspective view of a case clamp as a preferred embodiment of the present invention.
Figure 2:
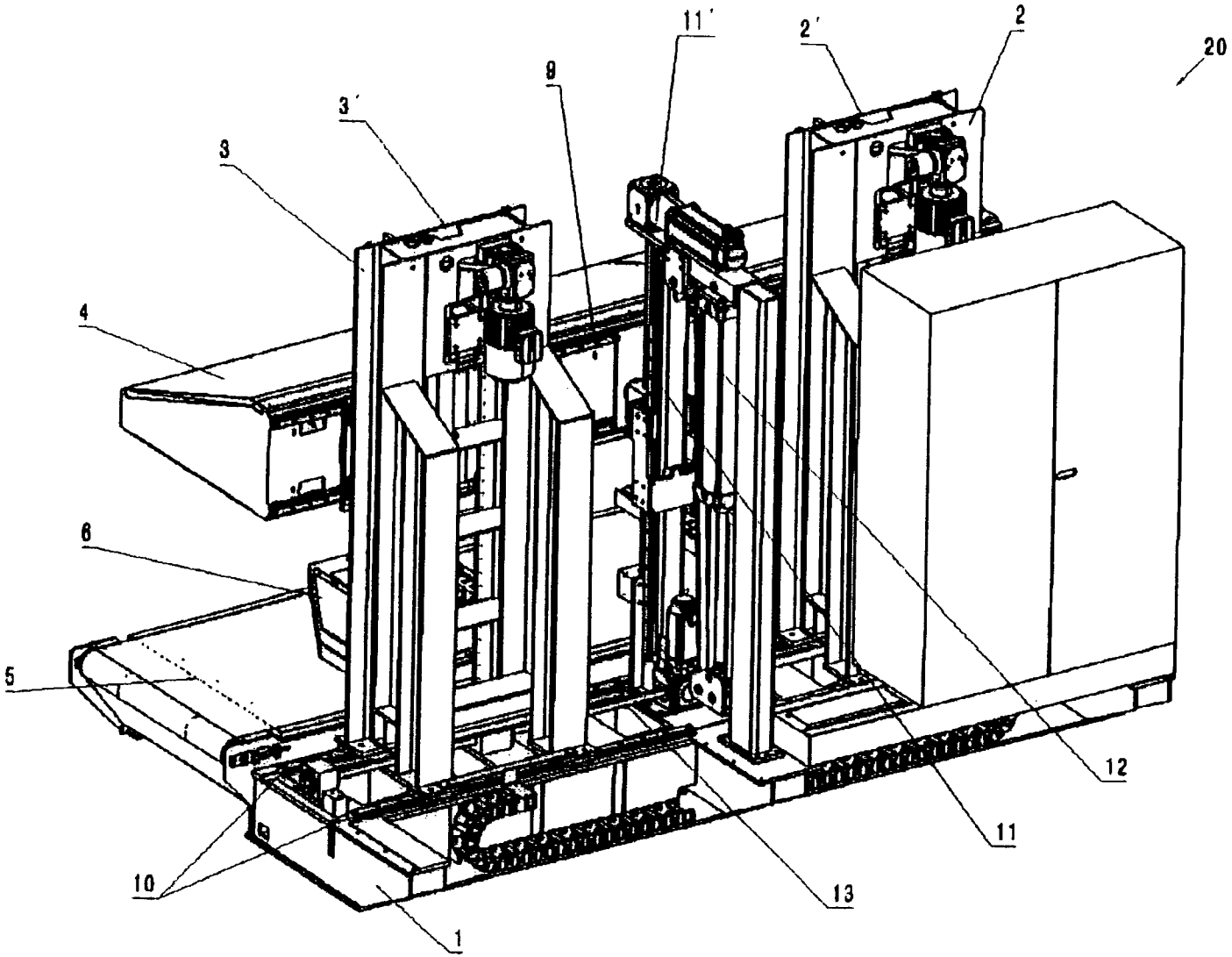
FIG. 2 shows a diagram of a rear perspective view of the case clamp shown in FIG. 1.

A case clamp 20 as a preferred embodiment of the present invention is shown schematically in FIGS. 1 and 2 in perspective views. Case clamp 20 serves to clamp carcass parts to furniture carcasses, such as, for example, tall cupboards, top or bottom cupboards, other items of furniture or the like.

Case clamp 20 has a base frame 1, which may for example consist of a welded steel structure. Provided laterally on base frame 1 is a lower compression beam 1', which in the present embodiment is integrated with a feed device 5 which will be explained in even greater detail below.

In addition, disposed on base frame 1 in the present embodiment are two supports 2, 3 which in the present embodiment are both horizontally traversable on base frame 1. The traversability of supports 2, 3 is achieved here by way of guide rails 10 in addition to two, servomotor-driven ball-and-screw spindles 13 working in opposite directions. As may be seen best in FIG. 2, guide rails 10 are located at a distance from each other so that the supports can transmit a bending moment and dissipate corresponding forces into the base frame around an axis parallel to guide rails 10.

The free end 2', 3' of the supports opposite guide rails 10 is free (unsupported) with the result that supports 2, 3 are supported exclusively on base frame 1 in the vertical direction at least.

Disposed in pairs on supports 2, 3 respectively are horizontal compression beams 6, 7, i.e. a horizontal compression beam 6 is matched in operation to opposing horizontal compression beam 7 in each case. The traversability of horizontal compression beams 6, 7 along supports 2, 3 is achieved by way of a positioning device 14, in the form of a belt for example. Case clamp 20 also has an upper compression beam 4, which is supported by way of guide rails 8 so as to be vertically traversable on supports 2, 3. In addition, supports 2, 3 are also disposed so as to be horizontally traversable in relation to upper compression beam 4, that is to say by way of guide rails 9, which may best be seen in FIG. 2.

Within the scope of the present invention, horizontal and vertical are understood to be two directions which are orthogonal to each other. Thus the invention is not restricted such that the case clamp or its components must be exactly horizontally or vertically disposed, but rather that the directions referred to are orthogonal to each other.

Case clamp 20 also comprises a drive pillar 11 for upper compression beam 4, which in the present embodiment has a servo drive 11'. By means of this drive 11' it is possible to traverse upper compression beam 4 vertically along supports 2, 3. In this regard, a pneumatic counterweight 12 is integrated into drive pillar 11 by means of which drive 11' is largely relieved of the own weight loads arising from the movements of upper compression beam 4.

Finally, case clamp 20 in the present embodiment has a feed device 5, for example in the form of a belt conveyor, by means of which carcass parts or carcasses to be clamped may be transported into the case clamp or clamped carcasses may be transported out of the case clamp. In this regard, lower compression beam 1' in the present embodiment is integrated in feed device 5 which results in an especially compact and simple construction.

Due to completely dispensing with an upright support frame, case clamp 20 according to the invention enables a significantly simplified structural design with lower own weight and improved accessibility to the case clamp in addition to reduced space requirements.

The invention claimed is:

1. A case clamp for clamping carcass parts to furniture carcasses, comprising, a base frame, a lower compression beam located on and fixed to the base frame, at least two vertical supports located on the base frame, at least one of which is traversable horizontally with respect to the base frame along at least two spaced guide elements fixed to the base frame, at least one pair of horizontal compression beams located on each vertical support and vertically traversable on the vertical supports, and a single upper compression beam supported by both vertical supports and located above each pair of horizontal compression beams and vertically traversable with respect to said vertical supports, wherein the at least one horizontally traversable vertical support is supported only at a lower end thereof on the guide elements fixed to the base frame and is traversable horizontally with respect to the upper compression beam along at least two spaced guide elements fixed to the upper compression beam.

2. The case clamp according to claim 1, wherein both of the at least two vertical supports are traversable horizontally with respect to the base frame along said at least two spaced guide elements fixed to the base frame, both are supported only at a lower end thereof on the guide elements at least in the vertical direction and both are traversable horizontally with respect to the upper compression beam along said at least two guide elements fixed to the upper compression beam.

3. The case clamp according to claim 1 or 2, including a drive pillar for the single upper compression beam having a servo-drive for vertically moving the upper compression beam.

4. The case clamp according to claim 3, including a counterweight integrated into the drive pillar.

5. The case clamp according to claim 1, including a feed device in the lower compression beam for transporting carcasses into and out of the case clamp.

6. The case clamp according to claim 2, wherein the at least two spaced guide elements fixed to the base frame and the at least two spaced guide elements fixed to the compression beam are guide rails.

7. The case clamp according to claim 4, wherein the counterweight is a pneumatic counterweight.

8. The case clamp according to claim 5, wherein the feed device is a belt conveyor integrated into the lower compression beam.

9. The case clamp according to claim 5, wherein the at least two vertical supports are on the same side with respect to the direction of transport of the carcasses.

* * * * *